United States Patent [19]

Plapper et al.

[11] 4,210,416

[45] Jul. 1, 1980

[54] FINE-PARTICULATE ALKALI METAL ALUMINOSILICATES IN THE PROCESS OF WASHING AND CLEANING RAWHIDES AND FUR SKINS

[75] Inventors: Juergen Plapper, Hilden; Milan J. Schwuger, Haan; Heinz G. Smolka, Langenfeld; Klaus Schumann, Erkrath; Emanuel Arndt, Düsseldorf; Emil Ruscheinsky, Leverkusen, all of Fed. Rep. of Germany

[73] Assignee: Henkel Kommanditgesellschaft auf Aktien(Henkel KGaA), Duüseldorf, Fed. Rep. of Germany

[21] Appl. No.: 903,597

[22] Filed: May 8, 1978

[30] Foreign Application Priority Data

Jun. 27, 1977 [DE] Fed. Rep. of Germany ..... 2728812

[51] Int. Cl.[2] ..... D01C 3/00

[52] U.S. Cl. ..... 8/139.1; 8/139; 423/328

[58] Field of Search ..... 8/139, 139.1

[56] References Cited

U.S. PATENT DOCUMENTS

| | | | |
|---|---|---|---|
| 3,030,181 | 4/1962 | Milton | 23/113 |
| 3,962,132 | 6/1976 | Haschke et al. | 252/43 D |
| 4,071,377 | 1/1978 | Schwuger et al. | 252/179 |
| 4,083,793 | 4/1978 | Jakobi et al. | 252/99 |
| 4,089,929 | 5/1978 | Christophliemk et al. | 423/118 |
| 4,126,574 | 11/1978 | Reinwald et al. | 252/179 |

OTHER PUBLICATIONS

Wicki, H, SVF Fachorgan, 1964, 19, (No. 8), pp. 556–568.

*Primary Examiner*—A. Lionel Clingman
*Attorney, Agent, or Firm*—Hammond & Littell, Weissenberger & Muserlian

[57] ABSTRACT

In the process of washing and cleaning rawhides and fur skins before tanning comprising subjecting rawhides and fur skins to the action of an aqueous solution containing (1) surface-active compounds selected from the group consisting of anionic surface-active compounds, nonionic surface-active compounds and mixtures thereof, (2) emulsifiable solvents for fats and (3) electrolytes, removing said aqueous solution, rinsing, and recovering washed and cleaned rawhides and fur skins, the improvement consisting essentially of employing a fine-particulate, water-insoluble alkali metal aluminosilicate, containing bound water, of the formula $$(M_2O)_x.Al_2O_3.(SiO_2)_y$$

wherein M represents an alkali metal, x is an integer from 0.7 to 1.5 and y is an integer from 0.8 to 6, said aluminosilicates having an average particle size in the range of from 0.1 to 25$\mu$ and a calcium binding power of from 20 to 200 mg CaO/gm of anhydrous active substance measured at 22° C. according to the Calcium Binding Power Test Method set out in the specification, as partial or total replacement of said electrolyte and optionally partial replacement of said surface-active compounds, whereby the pH of said aqueous solution is maintained between 6.5 and 8.5.

11 Claims, No Drawings

FINE-PARTICULATE ALKALI METAL ALUMINOSILICATES IN THE PROCESS OF WASHING AND CLEANING RAWHIDES AND FUR SKINS

BACKGROUND OF THE INVENTION

The washing of preserved rawhides and fur skins before tanning has the purpose of removing dirt, blood, dung, preservatives, fat and water-soluble proteinacous compounds. This is done mostly in a paddle tub or in the tanning tumbler. Frequently service water is used which has a hardness of about 15° dH (degrees german hardness). The washing and cleaning solutions employ the following aids:

(a) Surface-active substances of an anionic or nonionic nature, which not only clean the skins, but also improve at the same time the feel of the fur.

(b) Fat solvents in emulsified form, such as hydroaromates (hydrogenated aromatic hydrocarbons) or petroleum-hydrocarbons.

(c) Inorganic salts, like common salt, which help to improve the washing effect of the tensides by an electrolytic effect. A high pH of 8.5 or over is undesired and can lead to damage of the skins and rawhides. The use of the inorganic salts leads to a high salt content of the waste waters, which is subject to increasing criticism.

A further problem in washing rawhides and skins, particularly when treating raw materials with a high fat content, is that the cleaned product can become fatted again (refatted) and the apparatus can be contaminated in the dilution stage on rinsing. In other words the suspended fat tends to deemulsify and deposit on dilution during rinsing. An improved stabilization of the wash liquors is thus desirable. Furthermore questions of sewage treatment and the resulting costs are becoming important and will become more and more important in the future.

OBJECTS OF THE INVENTION

An object of the present invention is to improve the process of washing and cleaning rawhides and fur skins before tanning while avoiding the drawbacks of the above process.

Another object of the present invention is the development in the process of washing and cleaning rawhides and fur skins before tanning comprising subjecting rawhides and fur skins to the action of an aqueous solution containing (1) surface-active compounds selected from the group consisting of anionic surface-active compounds, nonionic surface-active compounds and mixtures thereof, (2) emulsifiable solvents for fats and (3) electrolytes, removing said aqueous solution, rinsing, and recovering washed and cleaned rawhides and fur skins, the improvement consisting essentially of employing a fine-particulate, water-insoluble alkali metal aluminosilicate, containing bound water, of the formula $$(M_2O)_x \cdot Al_2O_3 \cdot (SiO_2)_y$$

wherein M represents an alkali metal, x is an integer from 0.7 to 1.5 and y is an integer from 0.8 to 6, said aluminosilicates having an average particle size in the range of from 0.1 to 25$\mu$ and a calcium binding power of from 20 to 200 mg CaO/gm of anhydrous active substance measured at 22° C. according to the Calcium Binding Power Test Method set out in the specification, as partial or total replacement of said electrolyte and optionally partial replacement of said surface-active compounds, whereby the pH of said aqueous solution is maintained between 6.5 and 8.5.

These and other object of the invention will become more apparent as the description thereof proceeds.

DESCRIPTION OF THE INVENTION

It has now been formed that the results of the prior art process for washing and cleaning rawhides and fur skins before tanning can be considerably improved by the use of certain alkali metal aluminosilicates. The following advantages are achieved.

1. Common salt or other electrolytes can be partly or completely eliminated, since a certain electrolytic effect is achieved by the use of the alkali metal aluminosilicates.

2. The alkali metal aluminosilicates have ion-exchanger properties and effect the elimination of the hardness components of the liquors. In particular the hardness formers released during the washing from the washed material are made harmless.

3. Overalkalization of the liquors is avoided. The pH-value with customary amounts of alkali metal aluminosilicates is between 6.5 and 8.5. Damage of the skins and rawhides is thus impossible.

4. The amount of surface-active substances, like anionic or nonionic tensides can be reduced by 50%. Nevertheless an improved washing effect is achieved, since the fur of the skins is more open and the residual amount of dirt is lower.

5. The stability of the liquors is increased so that re-fatting of the skins and deposits of fat and dirt on the apparatus are avoided. This is due, apart from the softening action of the alkali metal aluminosilicates, to a certain fat absorbing or binding power of these substances.

6. The above described properties of the alkali metal aluminosilicates, that is fat-binding, ion-exchange, possible savings in tensides and electrolytes, result in a definite relief to the waste waters.

7. Depending on the type of sewage treatment, the presence of alkali metal aluminosilicates in the waste water contributes to a simplified, more economical procedure. The mixing of acid tanning waste water with the alkali metal aluminosilicate-containing waste waters lead to more neutral waste waters since the alkali metal aluminosilicates act on acids like a neutralizing agent.

The subject of the invention therefore is the use of finely-divided water-insoluble, preferably water-containing alkali metal aluminosilicates of the general formula $$(M_2O)_x \cdot Al_2O_3 \cdot (SiO_2)_y$$

where M denotes an alkali metal ion, preferably a sodium ion, x a number from 0.7 to 1.5, y a number from 0.8 to 6, preferably 1.3–4, with a particle size of 0.1 to 25$\mu$, preferably 1 to 12$\mu$, which have a calcium binding power of 20 to 200 mg CaO/gm of anhydrous active substance, for washing and cleaning rawhides and fur skins.

More particularly, the present invention relates to an improvement in the process of washing and cleaning rawhides and fur skins before tanning comprising subjecting rawhides and fur skins to the action of an aqueous solution containing (1) surface-active compounds selected from the group consisting of anionic surface-active compounds, nonionic surface-active compounds and mixtures thereof, (2) emulsifiable solvents for fats and (3) electrolytes, removing said aqueous solution, rinsing, and recovering washed and cleaned rawhides and fur skins, the improvement consisting essentially of employing a fine-particulate, water-insoluble alkali metal aluminosilicate, containing bound water, of the formula $$(M_2O)_x \cdot Al_2O_3 \cdot (SiO_2)_y$$

wherein M represents an alkali metal, x is an integer from 0.7 to 1.5 and y is an integer from 0.8 to 6, said aluminosilicates having an average particle size in the range of from 0.1 to 25μ and a calcium binding power of from 20 to 200 mg CaO/gm of anhydrous active substance measured at 22° C. according to the Calcium Binding Power Test Method set out in the specification, as partial or total replacement of said electrolyte and optionally partial replacement of said surface-active compounds, whereby the pH of said aqueous solution is maintained between 6.5 and 8.5.

The calcium binding power is determined according to the method indicated before the examples.

The alkali metal aluminosilicates, to be used according to the present invention, can be produced synthetically in a simple manner, for example, by reaction of water-soluble silicates with water-soluble aluminates in the presence of water. For this purpose, aqueous solutions of the starting materials can be mixed with one another, or a component present in a solid state may be reacted with the other component present in the form of an aqueous solution. The desired aluminosilicates are also obtained by mixing the two components, present in a solid state, in the presence of water. Alkali metal aluminosilicates can also be produced from $Al(OH)_3$, $Al_2O_3$ or $SiO_2$ by reaction with alkali metal silicate solutions or aluminate solutions respectively. Finally, substances of this type are also formed from the melt, although, owing to the high melting temperatures required and the necessity of converting the melt into finely distributed products, this method appears to be less interesting from an economic viewpoint.

The alkali metal aluminosilicates and their preparation are described in U.S. Pat. No. 4,071,377, as well as in U.S. patent application Ser. No. 458,306, filed Apr. 5, 1974, now abandoned in favor of its continuation Ser. No. 800,308, filed May 25, 1977, now abandoned in favor of its continuation-in-part Ser. No. 956,851, filed Nov. 2, 1978. These alkali metal aluminosilicates as produced by precipitation, or converted to an aqueous suspension in a finely distributed state by other methods, may be converted from the amorphous state into the aged or crystalline state by heating to temperatures of from 50° to 200° C. The amorphous or crystalline alkali metal aluminosilicate, present in an aqueous suspension, can be separated from the remaining aqueous solution by filtration and can be dried at temperatures of, for example, 50° to 800° C. The product contains a greater or smaller quantity of bound water according to the drying conditions. Anhydrous products are obtained by drying for 1 hour at 800° C. However, the hydrous products are preferred, particularly those obtained when drying at 50° to 400° C., particularly 50° to 200° C. Suitable products can have, for example, water contents of approximately 2% to 30%, usually approximately 8% to 27%, relative to their total weight.

The precipitation conditions can contribute to the formation of the desired small particle sizes of from 1 to 12μ, the intermixed aluminate and silicate solutions, which may also be introduced simultaneously into the reaction vessel, are subjected to high shearing forces by, for example, intensively agitating the suspension. When crystallized alkali metal aluminosilicates are produced (these are preferably used in accordance with the invention), the formation of large possibly interpenetrating crystals, is thus prevented by slow agitation of the crystallizing compound.

Nevertheless, undesired agglomeration of crystal particles can occur during drying, so that it may be advisable to remove these secondary particles in a suitable manner by, for example, air separators. Alkali metal aluminosilicates obtained in a coarser states, and which have been ground to the desired grain size, can also be used. By way of example, mills and/or air separators, or combinations thereof, are suitable for this purpose.

Preferred products are, for example, synthetically produced crystalline alkali metal aluminosilicates of the composition $$0.7\text{–}1.1\ M_2O \cdot Al_2O_3 \cdot 1.3\text{–}3.3\ SiO_2,$$

in which M represents an alkali metal cation, preferably a sodium cation. It is advantageous if the alkali metal aluminosilicate crystallites have rounded corners and edges.

If it is desired to produce the alkali metal aluminosilicates with rounded corners and edges, it is advantageous to start with a preparation whose molar composition lies preferably in the range $$2.5\text{–}6.0\ M_2O \cdot Al_2O_3 \cdot 0.5\text{–}5.0\ SiO_2 . 60\text{–}200 H_2O$$

wherein M has the meaning given above and, in particular, signifies the sodium ion. This preparation is crystallized in a conventional manner. Advantageously, this is effected by heating the preparation for at least ½ hour at 70° C. to 120° C., preferably to 80° to 95° C., under agitation. The crystalline product is isolated in a simple manner by separating the liquid phase. If required, it is advisable to re-wash the products with water, and to dry them, before further processing. Even when working with a preparation whose composition differs only slightly from that stated above, one still obtains products having rounded corners and edges, particularly when the difference only relates to one of the four concentration parameters given above.

Furthermore, fine-particulate water-insoluble alkali metal aluminosilicates may also be used in the method of the invention which have been precipitated and aged or crystallized in the presence of water-soluble inorganic or organic dispersing agents. Products of this type are described in U.S. patent applications Ser. No. 503,467, filed Sept. 5, 1974, now abandoned; Ser. No. 763,667, filed Jan. 28, 1977, now abandoned; and Ser. No. 811,964, filed June 30, 1977, now Pat. No. 4,126,574. They are obtainable in a technically simple manner. Suitable water-soluble organic dispersing agents are surface-active compounds, non-surface-active-like aromatic sulfonic acid and compounds having a complex-forming capacity for calcium. The said dispersing agents may be introduced into the reaction mixture in an optional manner before or during precipitation, and, for example, they may be introduced in the form of a solution or they may be dissolved in the aluminate solution and/or silicate solution. Particularly satisfactory effects are obtained when the dispersing agent is dissolved in the silicate solution. The quantity of dispersing agent should be at least 0.05 percent by weight, preferably 0.1 to 5 percent by weight, based on the total amount of precipitate obtained. The product of precipitation is heated to temperatures of from 50° to 200° C. for ½ to 24 hours for the purpose of ageing or crystallization. By way of example, sodium lauryl ether sulfate, sodium polyacrylate, hydroxyethane diphosphonate and others may be mentioned from the large number of dispersing agents which may be used.

Compounds of the general formula $$0.7\text{–}1.1\ Na_2O\ .\ Al_2O_3\ .>2.4\text{–}3.3\ SiO_2$$

constitute a special variant, with respect to their crystal structure, of the alkali metal aluminosilicates to be used in accordance with the invention. The possibility of their use as auxiliary soaping agents does not differ from that of the other alkali metal aluminosilicates which have been mentioned.

Compounds of the formula $$0.7\text{–}1.1\ Na_2O\ .\ Al_2O_3 > 3.3\text{–}5.3\ SiO_2$$

constitute a further variant of the fine-particulate, water-insoluble alkali metal aluminosilicates to be used in accordance with the invention. The production of such products is based on a preparation whose molar composition lies preferably in the range $$2.5\text{–}4.5\ Na_2O\ .\ Al_2O_3.\ 3.5\text{–}6.5\ SiO_2.50\text{–}110\ H_2O.$$

This preparation is crystallized in a conventional manner. Advantageously, this is effected by heating the preparation for at least ½ hour to 100° to 200° C., preferably to 130° to 160° C., under vigorous agitation. The crystalline product is isolated in a simple manner by separation of the liquid phase. If required, it is advisable to wash the products with water, and to dry them at temperatures of from 20° to 200° C., before further processing. The dried products thus obtained still contain bound water. When the products are produced in the manner described, one obtains very fine crystallites which come together to form spherical particles, possibly to form hollow balls having a diameter of approximately 1 to 4μ.

Furthermore, alkali metal aluminosilicates suitable for use in accordance with the invention are those which can be produced from calcinated (destructured) kaolin by hydrothermal treatment with aqueous metal hydroxide. The formula $$0.7\text{–}1.1\ M_2O\ .\ Al_2O_3\ .\ 1.3\text{–}2.4\ SiO_2\ .\ 0.5\text{–}5.0\ H_2O$$

corresponds to the products, M signifying an alkali metal cation, particularly a sodium cation. The production of the alkali metal aluminosilicates from calcinated kaolin leads, without any special technical expense, directly to a very fine-particulate product. The kaolin, previously calcinated at 500° to 800° C., is hydrothermally treated with aqueous alkali metal hydroxide at 50° to 100° C. The crystallization reaction thereby taking place is generally concluded after 0.5 to 3 hours.

Commercially available, elutriated kaolins predominantly comprise the clay mineral kaolinite of the approximate composition $Al_2O_3$ . 2 $SiO_2$ . 2 $H_2O$ and which has a layer structure. In order to obtain the alkali metal aluminosilicates, to be used in accordance with the invention, therefrom by hydrothermal treatment with alkali metal hydroxide, it is first necessary to destructure the kaolin, this being effected to best advantage by heating the kaolin to temperatures of from 500° to 800° C. for two to four hours. The X-ray amorphous anhydrous metakaolin is thereby produced from the kaolin. In addition to destructuring the kaolin by calcination, the kaolin can also be destructured by mechanical treatment (grinding) or by acid treatment.

The kaolins usable as starting materials are light-colored powders of great purity; of course, their iron content of approximately 2000 to 10,000 ppm Fe is substantially higher than the values of from 20 to 100 ppm Fe in the alkali metal aluminosilicates produced by precipitation from alkali metal silicate and alkali metal aluminate solutions. This higher iron content in the alkali metal aluminosilicates produced from kaolin is not disadvantageous, since the iron is firmly bedded in the form of iron oxide in the alkali metal aluminosilicate lattice and is not dissolved out. A sodium aluminosilicate having a cubic, faujasite-like structure is produced during the hydrothermal action of sodium hydroxide on destructured kaolin. Production of such alkali metal aluminosilicates from destructured kaolin with a low iron content are described in U.S. patent application Ser. No. 819,666, filed July 28, 1977, now U.S. Pat. No. 4,089,929.

Alkali metal aluminosilicates, usable in accordance with the invention, may also be produced from calcinated (destructured) kaolin by hydrothermal treatment with aqueous alkali metal hydroxide with the addition of silicon dioxide or a compound producing silicon dioxide. The mixture of alkali metal aluminosilicates of differing crystal structure, generally obtained thereby, comprises very fine-particulate crystal particles having a diameter of less than 20μ, and 100% of which usually comprises particles having a diameter of less than 10μ. In practice, this conversion of the destructured kaolin is effected preferably with aqueous sodium hydroxide and water glass. A sodium aluminosilicate J is thereby produced which is known by several names in the literature, for example, molecular sieve 13 X or zeolite NaX (see O. Grubner, P. Jiru and M. Ralek, "Molecular Sieves", Berlin 1968, pages 32, 85–89), when the preparation is preferably not agitated during the hydrothermal treatment, at all events when only low shearing energies are used and the temperature preferably remains at 10° to 20° C. below the boiling temperature (approximately 103° C.). The sodium aluminosilicate J has a cubic crystal structure similar to that of natural faujasite. The conversion reaction may be influenced particularly by agitating the preparation, at elevated temperature (boiling heat at normal pressure or in an autoclave) and greater quantities of silicate, that is, by a molar preparation ratio $SiO_2$: $Na_2O$ of at least 1, particularly 0.1 to 1.45, such that sodium aluminosilicate F is produced in addition to, or instead of, sodium aluminosilicate J. Sodium aluminosilicate F is designed "zeolite P" or "type B" in the literature (see D. W. Breck, "Zeolite Molecular Sieves", New York, 1974, page 72). Sodium aluminosilicate F has a structure similar to the natural zeolites gismondine and garronite and is present in the form of crystallites having an externally spherical appearance. In general, the conditions for producing the sodium aluminosilicate F and for producing mixtures of J and F are not critical than those for a pure crystal type A.

The method according to the invention for washing and cleaning rawhides and fur skins is carried out in known manner e.g. in a paddle tub or in the tanning tumbler. The alkali metal aluminosilicates are preferably used in combination with surface-active compounds or tensides, particularly anionic and nonionic tensides and then mixtures. The anionic surface-active compounds which can be used are particularly higher molecular weight sulfates or sulfonates having 8 to 18 carbon atoms, such as primary and secondary alkyl sulfates, alkyl sulfonates or alkylaryl sulfonates, preferably alkylphenyl sulfonate. Suitable nonionic tensides are, for example, the adducts of from 5 to 30 mols of ethylene oxide onto higher fatty alcohols, fatty acids or fatty amines having 8 to 18 carbon atoms, and alkylphenols having 8 to 18 carbon atoms in the alkyl. The anionic and nonionic tensides can be used to advantage in admixture, but also individually, depending on the material to be washed. In addition it is possible to add the alkali metal aluminosilicates as special aids to conventional wash liquors.

In the case of the washing process according to the invention, 2 to 5 gm/l of tensides and 1 to 4 gm/l of alkali metal aluminosilicates are required.

In order to enhance the fat-dissolving action of the cleaning liquor when washing very greasy furs, fat solvents which are emulsifiable can be added in amounts of 1 to 5 gm/l. Suitable solvents are selected from the group of the petroleum hydrocarbons, hydroaromates or hydrogenated aromatic hydrocarbons, alkyl benzenes and mineral oils.

The use of the finely divided, water-insoluble alkali metal aluminosilicates according to the invention permits to obtain the above described advantage over the conventional washing process. In particular we refer again to the improvement in the quality of the product, savings in tensides and salts and the improvement in the quality of the waste water. The alkali metal aluminosilicates can be transformed easily as dry powders into stable dispersions by stirring them into water or solutions containing dispersing agents and be handled easily in this form and be diluted with water without difficulties.

The following preparations and examples are illustrative of the practice of the invention without being limitative in any manner.

PREPARATIONS

I. The production of suitable alkali metal aluminosilicates

The silicate solution was added to the aluminate solution under vigorous agitation in a vessel having a capacity of 15 liters. Agitation was effected at 3000 r.p.m. by means of an agitator having a dispersing disc. The two solutions were at room temperature. An X-ray amorphous sodium aluminosilicate was formed as a primary product of precipitation with an exothermic reaction. After agitating for 10 minutes, the suspension of the precipitation product was transferred to a crystallizer and, for the purpose of crystallization, remained in the crystallizer for 6 hours at 90° C. under agitation (250 r.p.m.). The mother liquor was drawn off from the crystal sludge and the filtration residue was washed with deionized water until the washing water flowing off had a pH value of approximately 10. Therefore the washed filtration residue was dried as specified. Instead of the dried sodium aluminosilicate, the suspension of the crystallization product or the crystal sludge was also used to produce the auxiliary soaping agents. The water contents were determined by heating the predried products to 800° C. for 1 hour. The sodium aluminosilicates, washed or neutralized to the pH value of approximately 10, and then dried, were subsequently ground in a ball mill. The grain size distribution was determined by means of a sedimentation balance.

The calcium binding power of the aluminosilicates was determined in the following manner:

1 gm of aluminosilicate (based on the anhydrous active substance) was added to 1 l of an aqueous solution containing 0.594 gm of $CaCl_2$ (=300 mg CaO/l=30° dH) and adjusted to a pH value of 10 with diluted NaOH. The suspension was then vigorously agitated for 15 minutes at a temperature of 22° C. (−2° C.). The residual hardness x of the filtrate was determined after filtering off the aluminosilicate. The calcium binding capacity was calculted therefrom in mg CaO/gm AS in accordance with the formula: $(30-x)\cdot 10$. For short hand purposes the above procedure is hereinafter referred to by the Calcium Binding Power Test Method.

When the calcium binding capacity is determined at higher temperatures, for example, at 60° C., far better values are found than when it is determined at 22° C.

Conditions for producing sodium aluminosilicate A

| | |
|---|---|
| Precipitation: | 2.935 kg of aluminate solution of the composition: 17.7% $Na_2O$, 15.8% $Al_2O_3$, 66.6% $H_2O$<br>0.15 kg of caustic soda<br>9.420 kg of water<br>2.445 kg of a 28.5% sodium silicate solution of the composition 1 $Na_2O$ . 6.0 $SiO_2$, freshly prepared from commercially available water glass and slightly alkali-soluble silicic acid |
| Crystallization: | 6 hours at 90° C. |
| Drying: | 24 hours at 100° C. |
| Composition: | 0.9 $Na_2O$ . 1 $Al_2O_3$ . 2.04 $SiO_2$. 4.3 $H_2O$ (= 21.6% $H_2O$) |
| Degree of crystallization: | Fully crystalline. |
| Calcium binding power: | 170 mg CaO/gm active substance. |

The particle size distribution, determined by sedimentation analysis, resulted in a mixture range of the particle size distribution curve at 3 to 6μ.

The sodium aluminosilicate A exhibits the following interference lines in the X-ray diffraction graph:

d values, photographed with Cu-$K_\alpha$ radiation in Å

| I |
|---|
| — |
| 12.4 |
| — |
| 8.6 |
| 7.0 |
| — |
| 4.1 (+) |
| — |
| 3.68 (+) |
| 3.38 (+) |
| 3.26 (+) |
| 2.96 (+) |
| — |
| — |
| 2.73 (+) |
| — |

-continued

| |
|---|
| 2.60 (+) |

It is quite possible that all these interference lines will not appear in the X-ray diffraction graph particularly when the aluminosilicates are not fully crystallized. Thus, the most important d values for characterizing these types have been characterized by a "(+)".

Conditions for producing sodium aluminosilicate B

| | |
|---|---|
| Precipitation: | 7.63 kg of an aluminate solution of of the composition 13.2% $Na_2O$; 8.0% $Al_2O_3$; 78.8% $H_2O$; 2.37 kg of a sodium silicate solution of the composition 8.0% $Na_2O$; 26.9% $SiO_2$; 65.1% $H_2O$; |
| Preparation ratio in mol: | 3.24 $Na_2O$; 1.0 $Al_2O_3$; 1.78 $SiO_2$; 70.3 $H_2O$; |
| Crystallization: | 6 hours at 90° C.; |
| Drying: | 24 hours at 100° C.; |
| Composition of the dried product | 0.99 $Na_2O$ . 1.00 $Al_2O_3$ . 1.83 $SiO_2$ . 4.0 $H_2O$; (= 20.9% $H_2O$) |
| Crystalline form: | Cubic with greatly rounded corners and edges; |
| Average particle diameter: | 5.4μ |
| Calcium binding power: | 172 mg CaO/gm active substance. |

Conditions for producing sodium aluminosilicate C

| | |
|---|---|
| Precipitation: | 12.15 kg of an aluminate solution of the composition 14.5% $Na_2O$; 5.4% $Al_2O_3$; 80.1% $H_2O$; 2.87 kg of a sodium silicate solution of the composition 8.0% $Na_2O$; 26.9% $SiO_3$; 65.1% $H_2O$; |
| Preparation ratio in mol: | 5.0 $Na_2O$; 1.0 $Al_2O_3$; 2.0 $SiO_2$; 100 $H_2O$; |
| Crystallization: | 1 hour at 90° C.; |
| Drying: | Hot atomization of a suspension of the washed product (pH 10) at 295° C.; Content of solid substance in the suspension 46% |
| Composition of the dried product: | 0.96 $Na_2O$ . 1 $Al_2O_3$ . 1.96 $SiO_2$ . 4 $H_2O$; |
| Crystalline form: | Cubic with greatly rounded corners and edges; Water content 20.5%; |
| Average particle diameter: | 5.4μ |
| Calcium binding power: | 172 mg CaO/gm active substance. |

Conditions for producing potassium aluminosilicate D

The sodium aluminosilicate C was produced in the first instance. After the mother liquor had been drawn off, and the crystalline mass had been washed to the pH value 10 with demineralized water, the filtration residue was suspended in 6.1 l of a 25% KCl solution. The suspension was heated for a short time to 80° to 90° C., and was then cooled, filtered off again and washed.

| | |
|---|---|
| Drying: | 24 hours at 100° C.; |
| Composition of the dried product: | 0.35 $Na_2O$ . 0.66 $K_2O$ . 1.0 $Al_2O_3$ 1.96 $SiO_2$ . 4.3 $H_2O$; (water content 20.3%) |

Conditions for producing sodium aluminosilicate E

| | |
|---|---|
| Precipitation: | 0.76 kg of aluminate solution of the composition: 36.0% $Na_2O$, 59.0% $Al_2O_3$, 5.0% water 0.94 kg of caustic soda; 9.94 kg of water; 3.94 kg of a commercially available sodium silicate solution of the composition: 8.0% $Na_2O$, 26.9% $SiO_2$, 65.1% $H_2O$; |
| Crystallization: | 12 hours at 90° C.; |
| Drying: | 12 hours at 100° C.; |
| Composition: | 0.9 $Na_2O$ . 1 $Al_2O_3$ . 3.1 $SiO_2$ . 5 $H_2O$; |
| Degree of crystallization: | Fully crystalline. |

The maximum range of the particle size distribution curve at 3 to 6μ.

| | |
|---|---|
| Calcium binding power: | 110 mg CaO/gm active substance. |

The aluminosilicate E exhibited the following interference lines in the X-ray diffraction graph:

d-values, photographed with Cu-$K_\alpha$ radiation in Å

| |
|---|
| 14.4 |
| — |
| 8.8 |
| — |
| — |
| 4.4 |
| — |
| 3.8 |
| — |
| — |
| — |
| — |
| 2.88 |
| 2.79 |
| — |
| 2.66 |
| — |

Conditions for producing sodium aluminosilicate F

| | |
|---|---|
| Precipitation: | 10.0 kg of an aluminate solution of the composition: 0.84 kg $NaAlO_2$ + 0.17 kg NaOH + 1.83 kg $H_2O$; 7.16 kg of a sodium silicate solution of the composition 8.0% $Na_2O$, 26.9% $SiO_2$, 65.1% $H_2O$; |
| Crystallization: | 4 hours at 150° C.; |
| Drying: | Hot atomization of a 30% suspension of the washed product (pH 10); |
| Composition of the dried product: | 0.98 $Na_2O$ . 1 $Al_2O_3$ . 4.12 $SiO_2$ . 4.9 $H_2O$; |
| The particles were of spherical shape; the average diameter of the balls was approximately 3 to 6μ. | |
| Calcium binding power: | 132 mg CaO/gm active substance at 50° C. |

Conditions for producing sodium aluminosilicate G

| | |
|---|---|
| Precipitation: | 7.31 kg aluminate (14.8% $Na_2O$, 9.2% $Al_2O_3$, 76.0% $H_2O$) 2.69 kg silicate (8.0% $Na_2O$, 26.9% $SiO_2$, 65.1% $H_2O$); |

-continued

| | |
|---|---|
| Preparation ratio in mol: | 3.17 $Na_2O$, 1.0 $Al_2O_3$, 1.82 $SiO_2$, 62.5 $H_2O$; |
| Crystallization: | 6 hours at 90° C.; |
| Composition of the dried product: | 1.11 $Na_2O$ . 1 $Al_2O_3$ . 1.89 $SiO_2$, 3.1 $H_2O$ (= 16.4% $H_2O$); |
| Crystalline structure: | Mixed structural type in the ratio 1:1; |
| Crystalline form: | Rounded crystallites; |
| Average particle diameter: | 5.6μ. |
| Calcium binding power: | 105 mg CaO/gm active substance at 50° C. |

Conditions for producing sodium aluminosilicate H produced from kaolin

1. Destructuring Kaolin

In order to activate the natural kaolin, samples of 1 kg were heated to 700° C. in a Schammote crucible for 3 hours. The crystalline kaolin $Al_2O_3 . 2 SiO_2 . 2 H_2O$ was thereby converted to the amorphous metakaolin $Al_2O_3 . 2 SiO_2$.

2. Hydrothermal treatment of metakaolin

The alkali solution was placed in an agitating vessel and the calcined kaolin was added under agitation at temperatures between 20° and 100° C. The suspension was brought to the crystallization temperature of 70° to 100° C. under agitation, and was maintained at this temperature until the crystallization operation had terminated. The mother liquor was subsequently drawn off and the residue was washed with water until the washing water draining off had a pH value of from 9 to 11. The filter cake was dried and was subsequently crushed to a fine powder or was ground to remove the agglomerates produced during drying. This grinding process was omitted when the filtration residue was further processed in a wet state or when the drying operation was performed by means of a spray dryer or a flow dryer. Alternatively, the hydrothermal treatment of the calcined kaolin can be performed in a continuous operation.

| | |
|---|---|
| Preparation: | 1.65 kg of calcined kaolin<br>13.35 kg of 10% NaOH, mixed at room temperature; |
| Crystallization: | 2 hours at 100° C.; |
| Drying: | 2 hours at 160° C. in a vacuum drying cabinet; |
| Composition: | 0.88 $Na_2O$ . 1 $Al_2O_3$ . 2.14 $SiO_2$ . 3.5 $H_2O$ (= 18.1% $H_2O$); |
| Crystalline structure: | Mixed structural type like Na aluminosilicate G, although in the ratio 8:2. |
| Average particle diameter: | 7.0μ. |
| Calcium binding power: | 126 mg CaO/mg active substance. |

Conditions for producing sodium aluminosilicate J produced from kaolin

The destructuring of the kaolin and the hydrothermal treatment were effected in the same manner as in the case of H.

| | |
|---|---|
| Preparation: | 2.6 kg of calcined kaolin,<br>7.5 kg of 50% NaOH,<br>7.5 kg of water glass,<br>51.5 kg of deionized water,<br>mixed at room temperature; |
| Crystallization: | 24 hours at 100° C., without agitation; |
| Drying: | 2 hours at 160° C. in a vacuum drying cabinet; |

-continued

| | |
|---|---|
| Composition: | 0.93 $Na_2O$ . 1 $Al_2O_3$ . 3.60 $SiO_2$ . 6.8 $H_2O$ (= 24.6% $H_2O$); |
| Crystalline structure: | Sodium aluminosilicate J in accordance with above definition, cubic crystallites; |
| Average particle diameter: | 8.0μ |
| Calcium binding power: | 105 mg CaO/gm active substance. |

EXAMPLE 1

Washing raw, greasy, greatly soiled sheep skins.

A. Standard Process

| | |
|---|---|
| **Prewashing** | |
| Temperature | about 35° C. |
| Liquor ratio | 1:20 |
| Time | 60 minutes |
| Formula: | 2 gm/l (WAS) commercial alkyl sulfate, chain length $C_{12}$–$C_{18}$<br>4 gm/l of a mixture of 15% alkylphenol + 9EO and 85% petroleum hydrocarbons<br>Rinsing at 35° C. |
| **Main Washing** | |
| Temperature | about 35° C. |
| Liquor ratio | 1:20 |
| Time | 60 minutes |
| Formula | 15 gm/l common salt<br>2 gm/l (was) commercial alkyl sulfate, chain length $C_{12}$–$C_{18}$<br>4 gm/l of a mixture of 15% alkylphenol + 9 EO and 85% petroleum hydrocarbons<br>1 gm/l of a commercial skin bleaching agent in combination with optical brighteners<br>Rinsing at about 35° C. |

B. Process according to the invention

| | |
|---|---|
| **Prewashing** | |
| Temperature | about 35° C. |
| Liquor ratio | 1:20 |
| Time | 60 minutes |
| Formula | 1.0 gm/l (WAS) of commercial alkylsulfate, chain length $C_{12}$–$C_{18}$<br>1.0 gm/l of a Na Al-silicate of preparation A<br>3.0 gm/l of a mixture of 15% alkylphenol + 9 EO and 85% petroleum hydrocarbons<br>Rinsing at about 35° C. |
| **Main Washing** | |
| Temperature | about 35° C. |
| Liquor ratio | 1:20 |
| Time | 60 minutes |
| Formula | 1 gm/l (WAS) commercial alkylsulfate, chain length $C_{12}$–$C_{18}$<br>1 gm/l of Na Al-silicate of preparation A<br>3 gm/l of a mixture of 15% alkylphenol + 9 EO and 85% petroleum hydrocarbons<br>1 gm/l of a commercial skin bleaching agent in combination with optical brighteners<br>Rinsing at about 35° C. |

| Formula | A | B |
|---|---|---|
| Feel | Normal, waddy | same |
| Fur | less open | loose, more open |
| Brightening | normal | brighter, cleaner |

The same results were obtained when any of Al-silicates of preparation B-J were employed in place of the Na Al-silicate of preparation A.

EXAMPLE 2

Washing raw greasy sheepskins.

A. Standard Process

| | |
|---|---|
| Prewashing | |
| Temperature | about 35° C. |
| Liquor ratio | 1:20 |
| Time | 60 minutes |
| Formula | 2 gm/l (WAS) commercial alkylbenzene sulfonate<br>4 gm/l of a mixture of 15% alkylphenol + 9 EO and 85% hydroaromates, e.g. Decalin ®<br>Rinsing at about 35° C. |
| Main washing | |
| Temperature | about 35° C. |
| Liquor ratio | 1:20 |
| Time | 60 minutes |
| Formula | 15 gm/l common salt<br>2 gm/l (WAS) commercial alkylsulfate, chain length $C_{12}$–$C_{18}$<br>4 gm/l of a mixture of 15% alkylphenol + 9 EO and 85% hydroaromates, e.g. Decalin ®<br>Rinsing at about 35° C. |

B. Process according to the invention

| | |
|---|---|
| Prewashing | |
| Temperature | about 35° C. |
| Liquor ratio | 1:20 |
| Time | 60 minutes |
| Formula | 1 gm/l (WAS) commercial alkylbenzene sulfonate<br>1 gm/l of Na Al-silicate of preparation B<br>4 gm/l of a mixture of 15% alkylphenol + 9 EO and 85% hydroaromates, e.g. Decalin ®<br>Rinsing at about 35° C. |
| Main washing | |
| Temperature | about 35° C. |
| Liquor ratio | 1:20 |
| Time | 60 minutes |
| Formula | 1 gm/l commercial alkylsulfate, chain length $C_{12}$–$C_{18}$<br>1 gm/l of Na Al-silicate of preparation B<br>4 gm/l of a mixture of 15% alkylphenol + 9 EO and 85% hydroaromates e.g. Decalin ®<br>Rinsing at about 35° C. |

According to Example 2B a better washing effect and a looser more open wool was obtained with the use of less wash-active substances. The same results were obtained when Al-silicates of preparations A and C-J were employed in place of preparation D.

EXAMPLE 3

Washing rawhides containing little natural fat, e.g. calf or filly hides

A. Standard Process

| | |
|---|---|
| Temperature | about 30° C. |
| Liquor ratio | 1:20 |
| Time | 60 minutes |
| Formula | 15 gm/l common salt<br>2–3 gm/l (WAS) commercial alkyl sulfate, chain length $C_{12}$–$C_{18}$<br>Rinsing at 30° C. |

B. Process according to the invention

| | |
|---|---|
| Temperature | about 30° C. |
| Liquor ratio | 1:20 |
| Time | 60 minutes |
| Formula | 1–2 gm/l (WAS) commercial alkyl sulfate, chain length $C_{12}$–$C_{18}$<br>1 gm/l of Al-silicate of preparation D<br>Rinsing at about 30° C. |

By washing according to Example 3B with only half the WAS and without common salt, we obtain an equally washing effect with good fur as according to Example 3A. The same effects can be obtained by subsitution any of the Al-silicates of preparations A–C and E–J for that of preparation D.

The preceding specific embodiments are illustrative of the practice of the invention. It is to be understood however, that other expedeients know to those skilled in the art or disclosed herein, may be employed without departing from the spirit of the invention or the scope of the appended claims.

We claim:

1. In the process of washing and cleaning rawhides and fur skins before tanning comprising subjecting rawhides and fur skins to the action of an aqueous solution containing (1) surface-active compounds selected from the group consisting of anionic surface-active compounds, nonionic surface-active compounds and mixtures thereof, (2) emulsifiable solvents for fats and (3) electrolyte, removing said aqueous solution, rinsing and recovering washed and cleaned rawhides and fur skins, the improvement consisting essentially of employing a fine-particulate, water-insoluble alkali metal aluminosilicate, containing bound water, of the formula $$(M_2O)_x.Al_2O_3.(SiO_2)_y$$

wherein M represents an alkali metal, x is an integer from 0.7 to 1.5 and y is an integer from 0.8 to 6, said aluminosilicates having an average particle size in the range of from 0.1 to 25μ and a calcium binding power of from 20 to 200 mg CaO/gm of anhydrous active substance measured at 22° C., as partial or total replacement of said electrolyte and optionally partial replacement of said surface-active compounds, whereby the pH of said aqueous solution is maintained between 6.5 and 8.5.

2. The process of claim 1 wherein said alkali metal aluminosilicates have an average particle size in the range of from 1 to 12μ.

3. The process of claim 1 wherein in said formula of y is an integer from 1.3 to 4.

4. The process of claim 1 wherein said alkali metal aluminosilicate has the formula $$0.7\text{–}1.1\ M_2O.Al_2O_3.1.3\text{–}3.3\ SiO_2$$

5. The process of claim 1 wherein said alkali metal aluminosilicate has the formula $$0.7\text{–}1.1\ Na_2O.Al_2O_3.>2.4\text{–}3.3\ SiO_2$$

6. The process of claim 1 wherein said alkali metal aluminosilicate has the formula $$0.7\text{–}1.1\ Na_2O.Al_2O_3.>3.3\text{-}5.3\ SiO_2$$

7. The process of claim 1 wherein said alkali metal aluminosilicate has the formula $$0.7\text{–}1.1\ M_2O.Al_2O_3.1.3\text{–}2.4\ SiO_2.0.5\text{–}5.0\ H_2O$$

as produced from calcined kaolin.

8. The process of claim 1 wherein said surface-active compounds are selected from the group consisting of primary $C_{8-18}$ alkylsulfates, secondary $C_{8-18}$ alkylsulfates, $C_{8-18}$ alkane sulfonates, $C_{8-18}$ alkylbenzene sulfonates, adducts of 5 to 30 mols of ethylene oxide onto higher $C_{8-18}$ fatty alcohol, $C_{8-18}$ alkylphenols, $C_{8-18}$ fatty acids, $C_{8-18}$ fatty amines, and mixtures thereof.

9. The process of claim 1 wherein said emulsifiable solvents for fats are selected from the group consisting of petroleum hydrocarbons, hydrogenated aromatic hydrocarbons, alkylbenzenes and mineral oils.

10. The process of claim 1 wherein said surface-active compounds are present in said aqueous solution in an amount of from 2 to 5 gm/liter, said aluminosilicates are present in said aqueous solution in an amount of from 1 to 4 gm/liter and completely replace said electrolytes.

11. A process of washing and cleaning rawhides and fur skins before tanning consisting essentially of tumbling rawhides and fur skins in an aqueous solution containing from 2 to 5 gm/liter of at least one surface-active compound selected from the group consisting of primary $C_{8-18}$ alkylsulfates, secondary $C_{8-18}$ alkylsulfates, $C_{8-18}$ alkane sulfonates, $C_{8-18}$ alkylbenzene sulfonates, adducts of 5 to 30 mols of ethylene oxide onto higher $C_{8-18}$ fatty alcohol, $C_{8-18}$ alkylphenols, $C_{8-18}$ fatty acids, $C_{8-18}$ fatty amines, and mixtures thereof, from 0 to 5 gm/liter of an emulsifiable solvent for fats and from 1 to 5 gm/liter of a fine particulate, water-insoluble alkali metal aluminosilicate, containing bound water, of the formula $$(M_2O)_x.Al_2O_3.(SiO_2)_y$$

wherein M represents an alkali metal, x is an integer from 0.7 to 1.5 and y is an integer from 0.8 to 6, said aluminosilicates having an average particle size in the range of from 0.1 to 25μ and a calcium binding power of from 20 to 200 mg CaO/gm of anhydrous active substance measured at 22° C., said aqueous solution being maintained at a pH of between 6.5 and 8.5, removing said aqueous solution, rinsing and recovering washed and cleaned rawhides and fur skins.

* * * * *

UNITED STATES PATENT AND TRADEMARK OFFICE

CERTIFICATE OF CORRECTION

PATENT NO. : 4,210,416

DATED : July 1, 1980

INVENTOR(S) : Juergen Plapper et al

It is certified that error appears in the above—identified patent and that said Letters Patent is hereby corrected as shown below:

In the Heading, Item [73], line 2, "Duüseldorf" should be

--Düsseldorf--.

Col. 12, line 30, Page 23, line 27, "(was)" should be

--(WAS)--.

Col. 13, over the table in line 1, should be -- RESULTS,--

Col. 16, line 19, Claim 11, line 11, "1 to 5" should be

--1 to 4--.

Signed and Sealed this

*Third* Day of *August 1982*

[SEAL]

*Attest:*

GERALD J. MOSSINGHOFF

*Attesting Officer*

*Commissioner of Patents and Trademarks*